US005535476A

United States Patent [19]

Kresse et al.

[11] Patent Number: 5,535,476

[45] Date of Patent: Jul. 16, 1996

[54] MOBILE AUTOMATIC FLOOR CLEANER

[75] Inventors: Franz Kresse, Hilden; Rainer Osberghaus, Duesseldorf, both of Germany

[73] Assignee: Henkel Kommanditgesellschaft auf Aktien, Duesseldorf, Germany

[21] Appl. No.: 177,663

[22] Filed: Jan. 5, 1994

[30] Foreign Application Priority Data

Jul. 5, 1991 [DE] Germany ..... 41 22 280.6

[51] Int. Cl.[6] ..... A47L 11/30

[52] U.S. Cl. ..... 15/320; 15/353; 210/167; 210/521; 210/532.1

[58] Field of Search ..... 15/320, 321, 353; 210/167, 521, 532.1

[56] References Cited

U.S. PATENT DOCUMENTS

| | | | |
|---|---|---|---|
| 2,774,089 | 12/1956 | Brown | 15/98 |
| 3,431,582 | 3/1969 | Grave | 15/321 |
| 3,996,640 | 12/1976 | Blue et al. | 15/320 |
| 4,194,263 | 3/1980 | Herpers et al. | 15/320 X |
| 4,202,778 | 5/1980 | Middlebeek | 210/532.1 X |
| 4,348,783 | 9/1982 | Swanson et al. | 15/320 |
| 4,466,155 | 8/1984 | Grave | 15/321 |
| 4,586,208 | 5/1986 | Trevarthen | 15/353 X |
| 4,741,069 | 5/1988 | Helm et al. | 15/320 |
| 4,747,948 | 5/1988 | North | 210/521 X |
| 4,945,602 | 8/1990 | Kohl et al. | 15/320 |
| 5,093,955 | 3/1992 | Blehert et al. | 15/353 X |
| 5,242,604 | 9/1993 | Young et al. | 210/521 X |
| 5,331,713 | 7/1994 | Tipton | 15/320 |

FOREIGN PATENT DOCUMENTS

| | | |
|---|---|---|
| 0185310 | 6/1986 | European Pat. Off. . |
| 0224055 | 6/1987 | European Pat. Off. . |
| 3708087 | 9/1988 | Germany . |

*Primary Examiner*—Chris K. Moore

*Attorney, Agent, or Firm*—Ernest G. Szoke; Wayne C. Jaeschke; Steven J. Trzaska

[57] ABSTRACT

An improved mobile cleaning apparatus is provided having an increased cleaning radius consisting of a movable carriage with integrated fresh and soiled liquid compartments contained therein which are separated by a fixed partition, a cleaning rotor is connected to the fresh liquid compartment at one end of the housing and at least one suction nozzle feeding into the soiled liquid compartment is also provided adjacent to the rotor. A pressure equalizing opening is provided in the upper part of the fixed partition. The fixed partition is also adapted to allow an overflow pipe to pass therethrough having an inlet opening situated in the soiled liquid compartment, and an outlet opening situated in the fresh liquid compartment.

9 Claims, 3 Drawing Sheets

MOBILE AUTOMATIC FLOOR CLEANER

CROSS REFERENCE TO RELATED APPLICATIONS

This is a continuation-in-part application of PCT International Application No. PCT/EP 92/01447 filed on Jun. 26, 1992, the entire contents of which are incorporated herein by reference.

FIELD OF THE INVENTION

This invention relates to a mobile automatic floor cleaner with integrated fresh and soiled liquid compartments, a cleaning rotor to be supplied from the fresh liquid compartment and at least one suction nozzle feeding into the soiled liquid compartment, the fresh and soiled liquid compartments being separated from one another by a fixed partition which allows liquid to pass through from the soiled liquid compartment into the fresh liquid compartment.

BACKGROUND OF THE INVENTION

One such mobile automatic floor cleaner is known from applicants' DE-OS 37 08 087. In this automatic floor cleaner, cleaning liquid containing cleaning concentrate is sprayed from a separate fresh liquid compartment via the rotor onto the floor to be treated. At the same time, the floor is scoured by the rotor. An arm-like water suction nozzle, which follows the rotor as the cleaner moves forward, is used to suck up the soiled water remaining after scrubbing so that, in a single operation, the floor can be thoroughly scrubbed and, at the same time, wiped dry to a certain extent by the suction effect.

The known automatic cleaner has its own drive and its own power supply, i.e. an on-board battery, so that it can be used independently of power points. However, the action radius of the known automatic cleaner is limited by the size of the fresh liquid compartment. Although, in the known cleaner, the partition between the fresh and soiled liquid compartments is also made of filter material to enable the soiled liquid sucked back to pass through the partition into the fresh liquid compartment, so that the fresh liquid compartment is kept full, it has been found in practice that this solution is unsatisfactory because the partition acting as a filter very quickly becomes blocked by soil particles with the result that insufficient soiled liquid passes through the filter into the fresh liquid compartment.

It is also known that the soiled water sucked back can be chemically cleaned in the automatic cleaner itself. However, this solution is unsatisfactory because it involves environmental pollution, besides which the still active cleaning liquid can be neutralized which is also undesirable.

SUMMARY OF THE INVENTION

Accordingly, the problem addressed by the present invention was to improve the automatic cleaner mentioned at the beginning in such a way that its action radius would be considerably increased in an environmentally friendly manner.

According to the invention, this problem has been solved by a mobile automatic floor cleaner of the type mentioned at the beginning which is characterized in that a pressure-equalizing opening is provided in the upper part of the partition and in that an overflow pipe passing through the partition is arranged between the fresh and soiled liquid compartments, the inlet opening of the overflow pipe being situated above the base of the soiled liquid compartment and its outlet opening being situated near the base of the fresh liquid compartment.

By virtue of this construction, the action radius of the automatic floor cleaner can be distinctly improved without the use of ecologically unsafe chemicals. The soiled water returned to the soiled liquid compartment initially sediments therein, i.e. the solid soil particles sink to the bottom of the soiled liquid compartment, while the cloudy soiled liquid free from soil particles passes through the overflow inlet opening arranged at a sufficient height into the fresh liquid compartment when the two compartments are filled to corresponding levels. The flow of liquid from the soiled liquid compartment into the fresh liquid compartment is governed solely by the two filling levels and not by the pressure prevailing in the container because the same pressure prevails in both compartments by virtue of the pressure equalizing opening. Accordingly, hardly any water is lost during the cleaning process so that the automatic floor cleaner has a very large action radius.

In one advantageous embodiment of the invention, a separating plate which separates two zones is provided in the soiled liquid compartment, the soiled water inlet opening being arranged in one zone and the overflow inlet opening being arranged in the other zone. By virtue of this arrangement, the soiled water sucked back passes very slowly into the vicinity of the overflow inlet opening because it first has to flow from one zone via the separating plate into the other zone. The soil particles thus have sufficient time to settle so that effective clarification occurs and no soil particles enter the fresh liquid compartment.

In one particularly practical variant, the separating plate is arranged substantially diagonally in the soiled liquid compartment and/or the separating plate has a rough surface. As a result of these measures, the soiled water sucked back first passes into one of the zones of the soiled liquid compartment, the soil particles immediately sedimenting on the separating plate, particularly under the effect of its rough surface, in addition to which no mixing occurs with the already sedimented soiled water present in the other zone of the soiled liquid compartment.

In another advantageous embodiment of the invention, a filter is arranged at the fresh liquid outlet of the fresh liquid compartment. This has the advantage that any soil particles which have entered the fresh liquid compartment after all cannot leave it and interfere with the cleaning process.

It has been found to be particularly suitable for the filter to be in the form of a filter cylinder with a replaceable filter cover arranged thereon. This filter cylinder has openings in its wall which are covered by the filter cover. The filter is arranged in such a way that it is permanently below the liquid surface. Through the movement of the automatic cleaner and the resulting movement of the water in the fresh liquid compartment, the filter cylinder is continually rinsed free by the swashing movement of the water so that blockages are largely avoided.

In order completely to avoid blockage of the filter cylinder and to replace the associated filter mantle as and when necessary, another embodiment of the invention is characterized in that a reduced pressure monitor is arranged between the filter and the pump connected to the fresh liquid outlet pipe. Accordingly, if no liquid or too little liquid passes through the filter as a result of a blockage, a corresponding reduced pressure is established behind the filter and is detected by the reduced pressure monitor. This reduced pressure monitor is connected to a suitable indicator (optical and/or acoustic) so that the machine operator can replace or clean the filter mantle accordingly.

BRIEF DESCRIPTION OF THE DRAWINGS

The invention is described by way of example in the following with reference to the accompanying drawings, wherein.

DETAILED DESCRIPTION OF THE INVENTION

Figure 1:
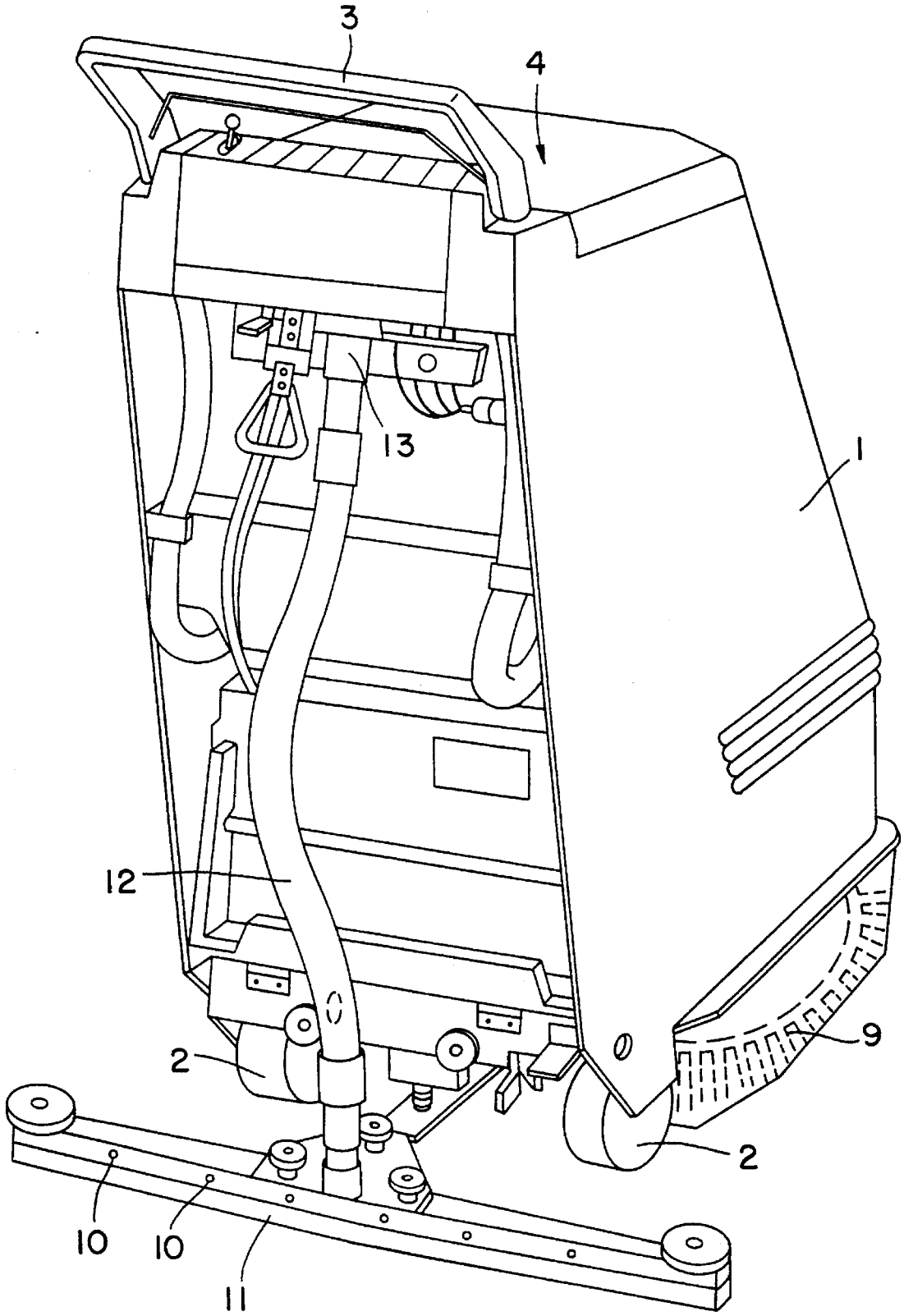
FIG. 1 is a perspective view of a mobile automatic floor cleaner according to the invention.

The mobile automatic floor cleaner shown in FIG. 1 comprises a movable carriage globally denoted by the reference 1 with rollers 2 and a steering handle 3 with an operating unit (not shown in detail). A large part of the interior of the movable carriage 1 accommodates a liquid tank which is globally denoted by the reference 4 and which is designed to be closed by a cover 5. The liquid tank 4 consists of a fresh water compartment 6 and a soiled water compartment 7, the two compartments being separated from one another by a fixed partition 8.

Shown on the underneath of the carriage 1 is a cleaning rotor 9 designed to be driven by a motor (not shown). Several suction nozzles 10 arranged on a suction arm 11 are provided in the rear lower region of the movable carriage 1, i.e. on that side of the rollers 2 remote from the cleaning rotor 9. A suction hose 12 is attached to the suction arm 11 at one end of suction hose 12, and is attached to fluid inlet connector 13 at an opposite end of suction hose 12. The fluid inlet connector 13 introduces soiled liquid into the soiled liquid compartment 7 of the liquid tank 4.

Figure 2:
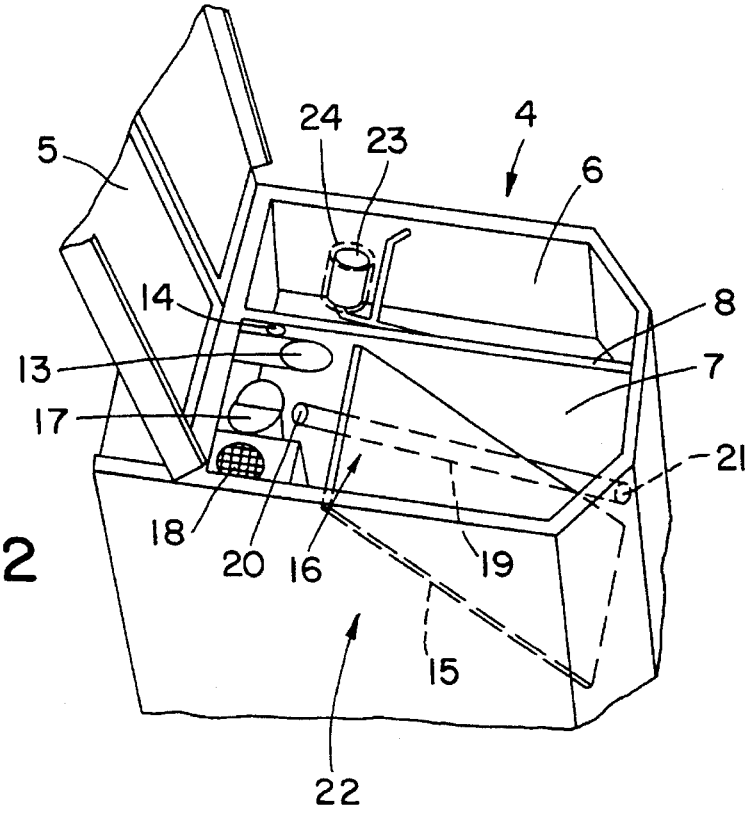
FIG. 2 is a perspective view of part of the liquid container of the automatic floor cleaner with fresh and soiled liquid compartments.

The design of the liquid tank 4 is crucial to the invention. First of all, a pressure equalizing opening 14 (FIG. 2) is provided in the partition 8 between the fresh and soiled liquid compartments 6 and 7 in the upper part of the tank 4 and, when the suction motor (not shown) located inside the movable carriage 1 is switched on to suck up the soiled water through the suction nozzles 10, the pressure equalizing opening 14 maintains a uniform pressure throughout the liquid tank 4.

The soiled liquid compartment 7 is divided into two zones by a diagonally arranged separating plate 15. The separating plate 15 has merely been outlined to leave the other parts in the tank clearly visible. The soiled water inlet opening, i.e. fluid inlet connector 13, is arranged in the upper zone 16 of the soiled liquid compartment 7 so that the soiled water first passes into the upper zone 16. In addition, a float 17 and a filter sieve 18 are also shown in the upper zone 16 of the soiled water compartment 7 in FIG. 2. Filter sieve 18 allows air drawn into compartment 7 along with the soiled water to escape from within liquid tank 4 into the outside environment. Float 17 is connected to the suction pump (not shown) so that in the event the water level in compartment 7 gets too high, float 17 will cause the suction motor to shut down.

Arranged between the fresh liquid compartment 6 and the soiled liquid compartment 7 is an overflow pipe 19 which passes through the partition 8, running substantially parallel thereto, and which comprises two openings angled through 90°, an inlet opening 20 and an outlet opening 21. The inlet opening 20 is arranged in the soiled liquid compartment 7 above the base thereof, but below the diagonal separating plate 15 in the lower zone 22 of the soiled liquid compartment 7. By contrast, the outlet opening 21 is arranged near the base of the fresh liquid compartment 6.

In addition, a fresh liquid outlet 23 is provided in the fresh liquid compartment 6. A floating suction funnel 24 is arranged at the outlet 23, being provided with a filter in the form of a filter cylinder 25. The filter cylinder 25 has a closed cover and base although an outlet nozzle 26 is provided in the base. The wall 27 of the filter cylinder 25 is heavily perforated although this has not been shown in detail in the drawing. A filter cover 28, preferably of synthetic cloth with a suitable mesh width (30 to 1,000 μm), is drawn over the cylinder 25.

Figure 3:
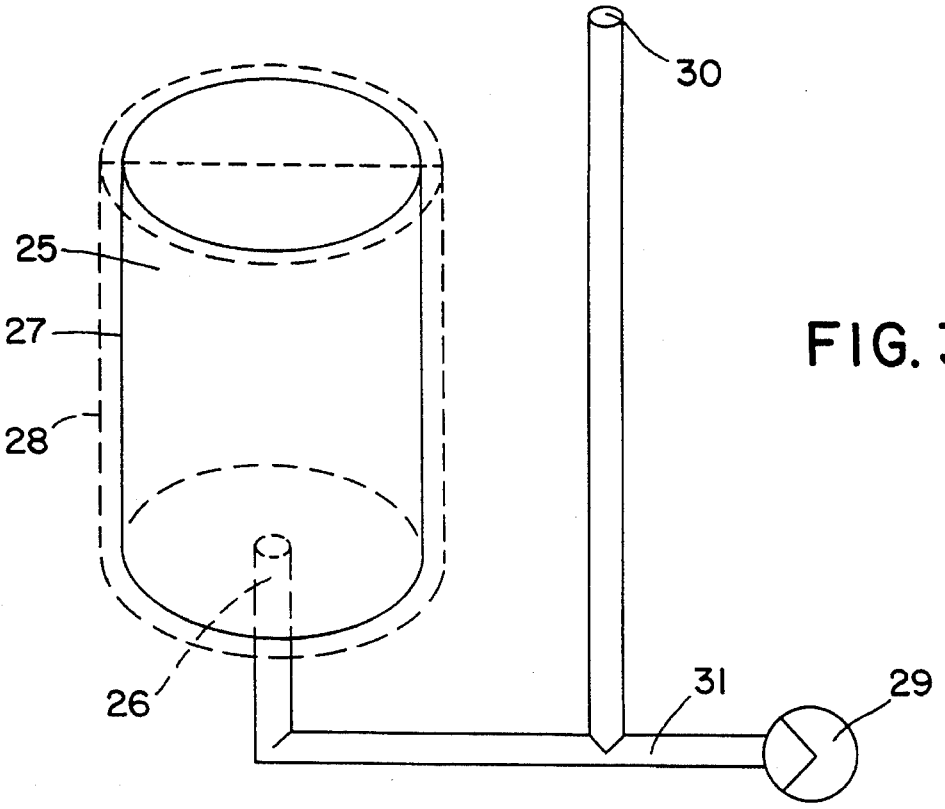
FIG. 3 is a simplified view of a filter for the outlet of the fresh liquid compartment.
Figure 4:
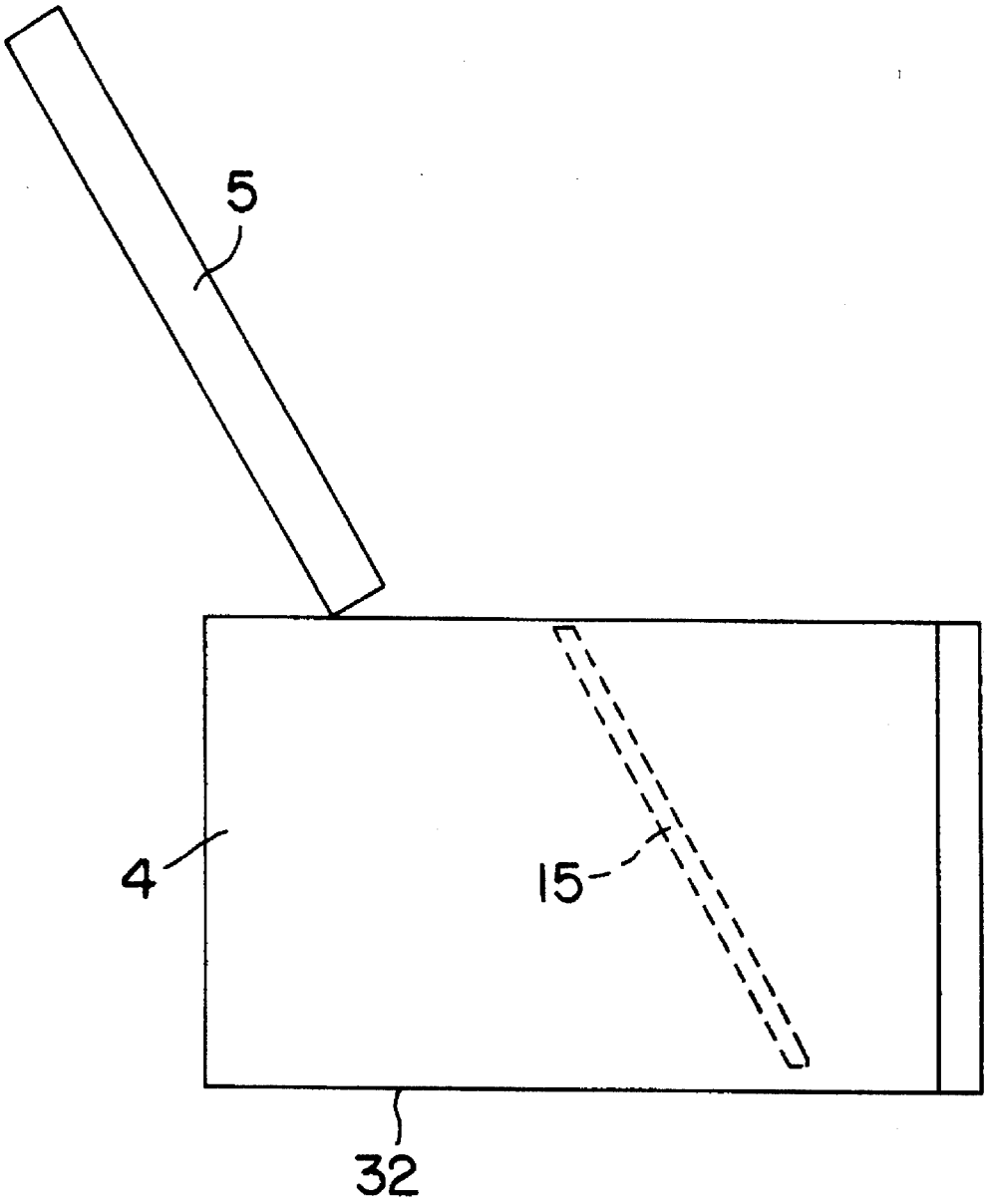
FIG. 4 is a simplified side elevation of the liquid container of FIG. 2.

A reduced pressure monitor 30, which again has only been shown in outline in FIG. 3, is connected via a tee between the filter cylinder 25 and a liquid pump 29—shown in outline only in FIG. 3—which transports the fresh liquid from the fresh liquid compartment 6 first through the filter cylinder 25 and then through a fresh liquid outlet pipe 31 to the cleaning rotor 9.

When the automatic cleaner is brought into operation, the liquid tank 4, i.e. both liquid compartments 6 and 7, is completely full. In the illustrated example, the tank 4 has a capacity of around 60 liters. When the suction motor (not shown) is switched on, a uniform reduced pressure is established in the two liquid compartments 6 and 7 under the effect of the pressure equalizing opening 14. The soiled water returned through the suction nozzles 10 passes through the suction hose 12 and the fluid inlet connector 13 into the upper zone 16 of the soiled water compartment 7. The soiled liquid is initially present in the upper zone 16 and does not yet come into contact with the partly clarified liquid situated below the separating plate 15, so that no mixing with the partly clarified liquid takes place. The solid soil particles present in the soiled water settle onto an upper surface of the separating plate 15 which is preferably ribbed.

The liquid from upper zone 16 has to pass through at the lowest point of the separating plate 15, preferably about 2 cm above the base 32 of the tank, in order to enter the lower zone 22 of the soiled water compartment 7. It is during this passage of soiled liquid from upper zone 16 to lower zone 22 that a sedimentation process takes place, i.e. the solid soil particles sink to the bottom of the soiled water compartment 7. The partly clarified, solids-free liquid then flows into lower zone 22 of the soiled water compartment 7. From lower zone 22, the partly clarified liquid then enters inlet opening 20 of overflow pipe 19 and is then discharged through outlet opening 21 into the fresh water compartment 6 at its base, so that the pre-clarified liquor is guided from the soiled water compartment 7 into an end of the fresh water compartment 6 opposite from the filter cylinder 25 and onto the bottom of the fresh water compartment 6.

The tank holds around 60 liters of water, approximately 2 liters being pumped off or taken up per minute. At any given time, the liquid from soiled water compartment 7 takes approximately 30 minutes to flow completely into fresh water compartment 6. This flow rate between compartments 6 and 7 provides ample time for the solid soil particles to settle at the bottom of soiled water compartment 7 once they enter therein, which accounts for the favorable sedimentation result.

The partly clarified liquid in the fresh water compartment 6 is siphoned out by liquid pump 29 through the filter cylinder 25 and pumped onto the surface to be cleaned through the cleaning rotor 9.

When the liquid pump 29 is on, water flows continuously through the filter cylinder 25. After a suitable period of operation and uptake of soil the filter cover 28 becomes clogged. This creates a resistance within filter cylinder 25 which causes the liquid pump 29 to build up a reduced pressure, which is detected by the reduced pressure monitor 30 connected to the fresh liquid outlet pipe 31. The reduced pressure monitor is connected to a visual or audio indicator (not shown) which acts as a signal that the cleaning liquid is exhausted, i.e. overladen with solid soil particles. The filter cover 28 may then be changed by the operator.

Basically, the filter cylinder 25 is arranged in such a way that liquid is continuously pumped out therethrough from fresh water compartment 6. Under the effect of the gentle swashing movements associated with the advance of the cleaner, the filter cover 28 is continually self-rinsed so that it does not clog up as quickly.

The invention is not of course confined to the embodiment illustrated in the drawing. Further embodiments are possible without departing from the basic concept of the invention. Thus, other fittings may be provided to improve sedimentation in the soiled liquid compartment 7 and so on.

We claim:

1. In a mobile automatic floor cleaning apparatus comprising a movable carriage means with integrated fresh and soiled liquid compartments, said fresh liquid compartment having a liquid discharge port, and said soiled liquid compartment having a liquid receiving port, a partition member separating said fresh and soiled liquid compartments, a cleaning rotor attached to said movable carriage to contact the floor, at least one suction means arranged in fluid communication with said soiled liquid compartment for collecting soiled liquid from said floor and feeding said soiled liquid to said soiled liquid compartment, the improvement comprising a pressure-equalizing opening provided in said partition member for maintaining equal pressure within both said fresh and soiled liquid compartments, and an overflow member carried by said partition member, said overflow member having an inlet opening extending into said soiled liquid compartment, and an outlet opening extending into said fresh liquid compartment, and a separator plate disposed substantially diagonally within said soiled liquid compartment, for separating soiled liquid contained in said soiled liquid compartment into a particle collection zone and a partially particle free zone.

2. The apparatus of claim 1 wherein said pressure-equalizing opening is positioned along an upper portion of said partition member.

3. The apparatus of claim 1 wherein said inlet opening of said overflow member extends into said particle free zone.

4. The apparatus of claim 1 wherein a face of said separator plate positioned in said particle collection zone further includes a rough surface.

5. The apparatus of claim 1 further including a filter member arranged within said fresh liquid compartment, in fluid communication with said liquid discharge aperture, said filter member being connected to pump means for pumping fresh liquid out of said rotor through said liquid discharge port.

6. The apparatus of claim 5 wherein said filter member further comprises a perforated cylinder having a closed top end and an apertured bottom end, said apertured bottom end being in fluid communication with said pump means.

7. The apparatus of claim 6 further including a jacket member covering said perforated cylinder for providing enhanced filtration.

8. The apparatus of claim 7 wherein said jacket member is made of mesh.

9. The apparatus of claim 5 further comprising a pressure monitor member connected to both said filter member and said pump means for measuring a reduction in pressure within said filter member.

* * * * *